US007886778B2

(12) United States Patent
McDowell

(10) Patent No.: US 7,886,778 B2
(45) Date of Patent: Feb. 15, 2011

(54) CARTRIDGE AND METHOD FOR FILLING A BULK CONTAINER WITH A FLOWABLE SUBSTANCE

(75) Inventor: Richard B. McDowell, Ligonier, PA (US)

(73) Assignee: Menasha Corporation, Neenah, WI (US)

( * ) Notice: Subject to any disclaimer, the term of this patent is extended or adjusted under 35 U.S.C. 154(b) by 55 days.

(21) Appl. No.: 12/351,657

(22) Filed: Jan. 9, 2009

(65) Prior Publication Data

US 2009/0114311 A1 May 7, 2009

Related U.S. Application Data

(62) Division of application No. 11/048,493, filed on Feb. 1, 2005, now Pat. No. 7,552,838.

(51) Int. Cl.
*B65B 1/04* (2006.01)
*B65D 25/14* (2006.01)

(52) U.S. Cl. ..... 141/10; 141/114; 141/314; 141/316; 220/495.1

(58) Field of Classification Search ..... 141/10, 141/114, 314–316; 220/495.01, 495.05, 220/495.03, 62.21, 62.1, 609, 720, 9.2; 229/117.05, 229/117.27, 117.28, 117.3, 117.32; 206/594; 383/903, 121, 3, 2, 119
See application file for complete search history.

(56) References Cited

U.S. PATENT DOCUMENTS 1,438,698 A 12/1922 Debs
1,623,107 A 4/1927 Goodykoontz
1,843,038 A 1/1932 McIlvain
2,316,658 A 4/1943 Ames
2,562,261 A 7/1951 Collins
2,973,119 A * 2/1961 Parker ..... 222/131
2,998,181 A 8/1961 Chasolen
3,039,670 A 6/1962 Hardon
3,089,622 A 5/1963 Westlake, Jr.
3,114,493 A 12/1963 Dunkin
3,173,579 A 3/1965 Curie et al.
3,333,392 A 8/1967 Calvert
3,339,721 A 9/1967 Goldstein
3,344,971 A 10/1967 Walker
3,375,967 A 4/1968 Robinson
3,411,264 A 11/1968 Farquhar
3,643,856 A 2/1972 Jones
3,744,702 A 7/1973 Ellison (Continued)

FOREIGN PATENT DOCUMENTS

EP 47616 A1 3/1982

*Primary Examiner*—Timothy L Maust
(74) *Attorney, Agent, or Firm*—Ungaretti & Harris LLP

(57) ABSTRACT

A cartridge for storing a flowable substance in a bulk container is disclosed. The cartridge includes a shell having a breakable score line and configured to sit inside the bulk container and a bag positioned within the shell and configured to be filled with the flowable substance. The bag has a port for introducing the flowable substance into the bag and a drain spout in fluid communication with the bag, allowing the flowable substance to be drained from the bag after filling. The breakable score line is configured to separate due to force exerted on the shell as the bag is filled, allowing the bag to expand inside the bulk container. A method of filling a bulk container with a flowable substance using the cartridge is also disclosed.

7 Claims, 6 Drawing Sheets

U.S. PATENT DOCUMENTS

RE27,872 E 1/1974 Esty
3,908,864 A * 9/1975 Capper ..... 222/105
3,913,822 A 10/1975 Heaps, Jr.
4,119,263 A * 10/1978 Cuthbertson et al. ..... 229/122.2
4,165,024 A 8/1979 Oswalt et al.
4,174,051 A 11/1979 Edwards et al.
4,232,803 A 11/1980 Muller et al.
4,268,555 A 5/1981 Kantz
4,335,830 A 6/1982 Garganese
4,380,314 A 4/1983 Langston et al.
4,585,143 A 4/1986 Fremow et al.
4,586,627 A 5/1986 Grigsby
4,601,407 A 7/1986 Gillard
4,623,072 A 11/1986 Lorenz
4,635,815 A 1/1987 Grigsby
4,693,413 A 9/1987 McFarland et al.
4,786,192 A 11/1988 Graves et al.
4,793,519 A 12/1988 Voorhies, Jr.
4,850,506 A 7/1989 Heaps et al.
4,863,021 A 9/1989 Crittenden
4,898,301 A 2/1990 Schick
4,934,654 A 6/1990 Linnemann
4,945,711 A 8/1990 Crittenden
5,042,684 A 8/1991 West et al.
5,050,775 A 9/1991 Marquardt
5,085,367 A 2/1992 Carstens
5,111,937 A 5/1992 Schutz
5,201,462 A 4/1993 Sada et al.
5,265,753 A 11/1993 Moorman
5,285,957 A 2/1994 Halsell
5,314,088 A 5/1994 Heuberger et al.
5,351,849 A * 10/1994 Jagenburg et al. ..... 229/117.3
5,353,982 A 10/1994 Perkins et al.
5,437,384 A * 8/1995 Farrell ..... 220/1.5
5,535,941 A 7/1996 Garza
5,566,851 A * 10/1996 Sasaki et al. ..... 229/117.27
5,749,489 A 5/1998 Benner et al.
5,799,861 A 9/1998 Bonner et al.
5,860,555 A 1/1999 Mayled
5,897,012 A * 4/1999 Sortwell ..... 220/4.28
5,906,568 A 5/1999 Sato et al.
5,938,108 A 8/1999 Williams et al.
5,944,252 A 8/1999 Connelly et al.
5,950,915 A 9/1999 Moen
5,975,413 A 11/1999 Moen
6,000,549 A 12/1999 Perkins
6,000,604 A 12/1999 Lapoint, III
6,029,884 A 2/2000 Roeland
6,112,928 A 9/2000 Black et al.
6,138,903 A 10/2000 Baker
6,186,932 B1 * 2/2001 Vallot ..... 493/189
6,290,124 B2 9/2001 Andrews, Sr. et al.
6,454,113 B1 * 9/2002 Schutz ..... 220/1.6
6,478,182 B2 11/2002 Karpisek
6,659,132 B2 * 12/2003 Smith et al. ..... 138/89
6,685,084 B2 2/2004 Timbrook et al.
6,761,307 B2 7/2004 Matsuoka
6,834,792 B1 12/2004 Perkins
6,902,061 B1 * 6/2005 Elstone ..... 206/600
7,552,838 B2 * 6/2009 McDowell ..... 220/495.01
7,607,564 B2 * 10/2009 Churvis et al. ..... 229/117.3
2002/0148885 A1 10/2002 Prince
2003/0059130 A1 3/2003 Yoneyama et al.
2004/0112012 A1 6/2004 Salva Transfiguracion et al.
2004/0187445 A1 9/2004 Hildebrandt, Jr.
2004/0188504 A1 9/2004 Pierce
2005/0082355 A1 4/2005 Beutler
2005/0196080 A1 9/2005 Stone et al.
2006/0169757 A1 8/2006 McDowell

* cited by examiner

CARTRIDGE AND METHOD FOR FILLING A BULK CONTAINER WITH A FLOWABLE SUBSTANCE

RELATED APPLICATION

This application is a division of application Ser. No. 11/048,493 filed on Feb. 1, 2005, now U.S. Pat. No. 7,552,838. The application is commonly assigned and incorporated by reference herein.

TECHNICAL FIELD

The invention relates to a cartridge for use with a bulk container, and more specifically, to a single-use cardboard cartridge containing a plastic bag configured to be placed in a bulk container and filled with a flowable substance.

BACKGROUND OF THE INVENTION

Flowable substances, and liquids in particular, are often difficult to store for transportation, because they must be completely contained to avoid spilling. One method of storage is by use of a bulk container having an impermeable bag contained therein. It is desirable to use a single-use disposable bag to avoid contamination of the contents. This bag should be safely and compactly storable when not in use and able to be easily and quickly inserted into the container, filled, and drained. Use of a cardboard cartridge designed to hold and protect the bag and assist in filling the bag once inserted into the bulk container is a known means of accomplishing these goals.

However, prior art cartridges face several disadvantages. Many such cartridges do not fold up securely enough to adequately protect the bag inside. Additionally, such cartridges often are not compact enough to be easily handled, stored, and transported. Further, many prior art cartridges are severely limited in their ability to be adapted to fit different shapes of containers. For example, prior art containers that fold into a triangular shape face difficulty in use with a container that is any shape other than symmetrically square. Thus, a need exists in the art for a cartridge for use in filling a bulk container that folds up securely and compactly, while able to be used without undue time and effort, and which can be adapted for use with a large variety of differently-shaped bulk containers.

The present invention is provided to solve the problems discussed above and other problems, and to provide advantages and aspects not provided by prior cartridges of this type. A full discussion of the features and advantages of the present invention is deferred to the following detailed description, which proceeds with reference to the accompanying drawings.

SUMMARY OF THE INVENTION

The present invention provides a cartridge for storing a flowable substance in a bulk container. The cartridge includes a shell, which is configured to sit inside the bulk container and has a breakable score line, and a bag, positioned within the shell, configured to be filled with the flowable substance. The bag has a port for introducing the flowable substance into the bag and a drain spout in fluid communication with the bag, allowing the flowable substance to be drained from the bag after filling. The breakable score line is configured to separate due to force exerted on the shell as the bag is filled, allowing the bag to expand inside the bulk container.

In one embodiment, the shell is substantially rectangular in shape and has a center fold area allowing the shell to fold into a more compact rectangular shape. In another embodiment, the shell is substantially rectangular in shape and has four breakable score lines, each located diagonal to one of four corners of the rectangular shell. In another embodiment, the shell includes an open portion allowing access to the bag. In another embodiment, the shell includes an opening, and the drain spout extends through the opening. In another embodiment, the cartridge includes separate locking piece configured to lock the drain spout in the opening. In another embodiment, the bulk container has a drain hole, and the drain spout extends through the drain hole when the bag is filled.

The present invention also provides a cartridge for storing a flowable substance in a bulk container, including a shell and a bag contained within the shell, configured to be filled with the flowable substance. The shell has a substantially rectangular base with a center fold area and a plurality of flaps foldably attached to the base that are inward to form a top surface of the shell. Two slots and two tabs are located on the shell, each of the two tabs located on one of the flaps. The tabs are received in the slots to secure the flaps in place. Further, the bag has a drain spout that extends through an opening in the shell. The cartridge is configured to fold at the center fold area to create a substantially rectangular folded cartridge.

In one embodiment, the cartridge includes a separate locking piece that slips around the drain spout adjacent the opening to lock the drain spout in the opening. In another embodiment, the drain spout has a flange and the separate locking piece is substantially C-shaped and slips underneath the flange and around the drain spout. In another embodiment, the shell has two additional slots and two additional tabs. Each of the additional tabs is located on one of the plurality of flaps and is received in one of the additional slots to secure the flaps in place. In another embodiment, a first end of the cartridge has a third flap located thereon. One of the two slots is located on the same end. Similarly, a second end opposite the first end has a fourth flap located thereon. The other of the two slots is located on the second end. The aforementioned first flap is located on a first side located between and adjacent to the first end and the second end, and the aforementioned second flap is located on a second side located opposite the first side. The folded first flap overlaps the folded third flap and the first tab is received in the first slot to secure the first flap and the third flap in place, and the folded second flap overlaps the folded fourth flap and the second tab is received in the second slot to secure the second side flap and the fourth flap in place. In another embodiment, the top surface of the shell includes a recessed portion and an open portion. The opening is located in the recessed portion and the open portion permits access to the bag.

The present invention also provides a method of filling a bulk container with a flowable substance. The method utilizes a cartridge that includes a shell and a bag within the shell configured to be filled with the flowable substance. The shell includes a breakable score line, and the bag includes a port for introducing the flowable substance into the bag. The cartridge is placed within the bulk container, and the bag is filled by introducing the flowable substance into the bag through the port. The breakable score line separates due to force exerted on the shell as the bag is filled, allowing the bag to expand inside the bulk container.

In one embodiment, the shell further includes a plurality of breakable score lines, and the plurality of breakable score lines separate due to force exerted on the shell as the bag is filled, allowing the bag to expand inside the bulk container. In another embodiment, the bag has a drain spout, and the expanding bag forces the drain spout through a drain hole in the bulk container. In another embodiment, the cartridge has a fold line allowing the cartridge to fold into a more compact shape. In this embodiment, the method additionally includes the step of unfolding the cartridge. In another embodiment, the method additionally includes the steps of providing a bridge extending across an open top of the container, attaching a portion of the bag proximate the port to the bridge, and fixing a hose to the port. The hose is in communication with a supply of the flowable substance. In another embodiment, the flowable substance is a liquid. Further, in another embodiment, the bag is constructed of an impermeable, multi-ply polymer.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
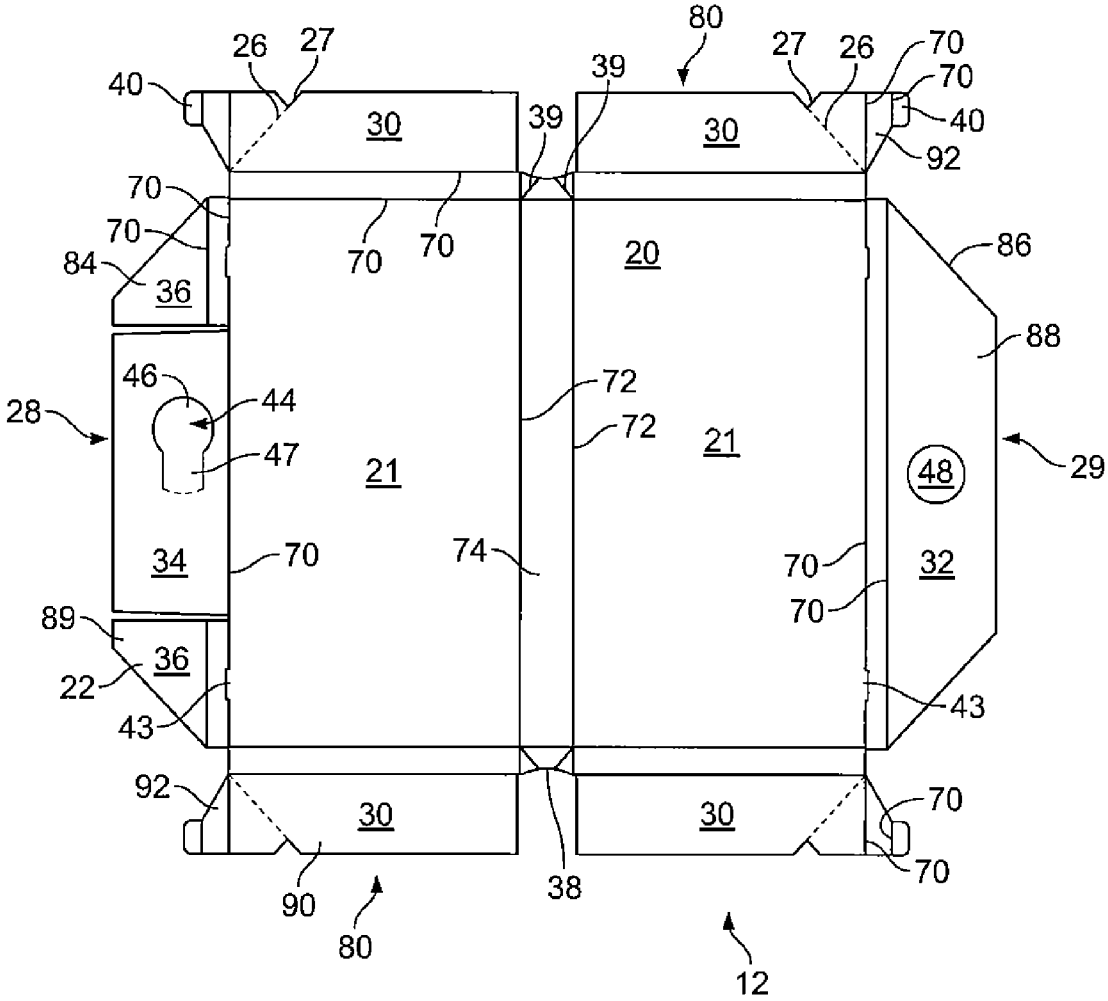
FIG. 1 is a top view of a blank used to construct the cartridge of the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
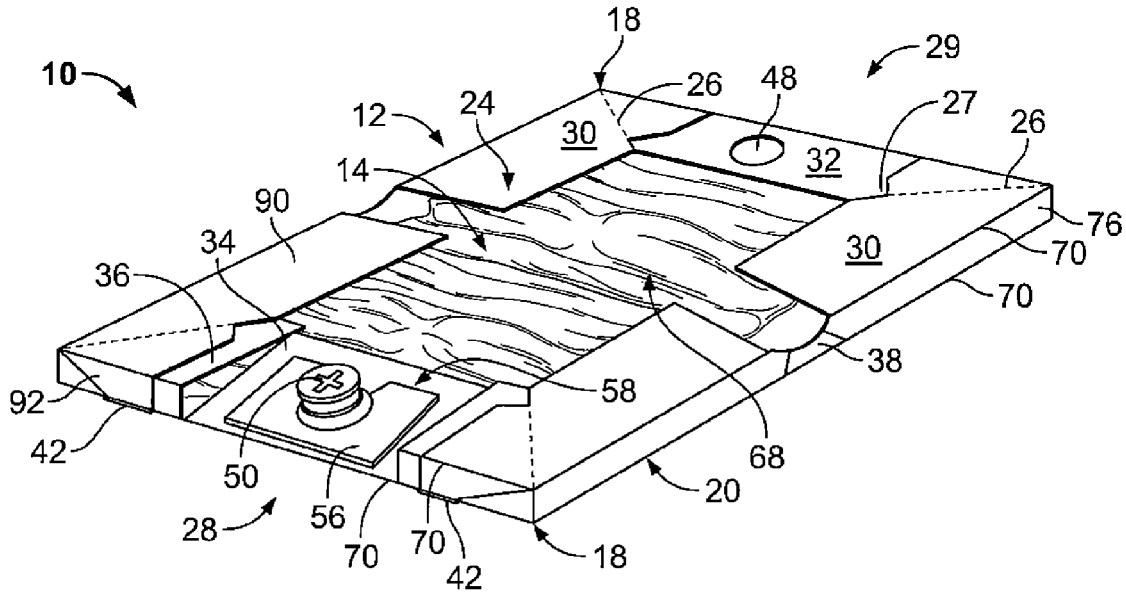
FIG. 2 is a perspective view of a cartridge of the present invention in an unfolded condition.
Figure 5:
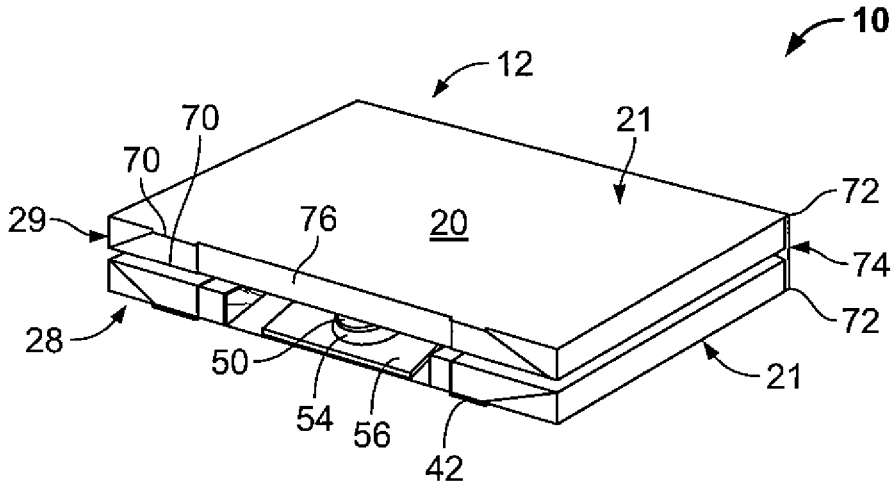
FIG. 5 is a perspective view of the cartridge of FIG. 2 in a folded condition.
Figure 6:
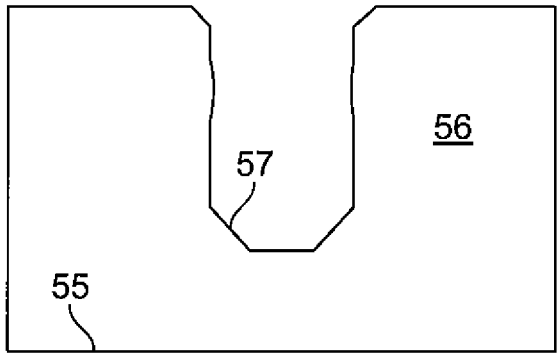
FIG. 6 is a top view of the locking piece of FIG. 3.
Figure 7:
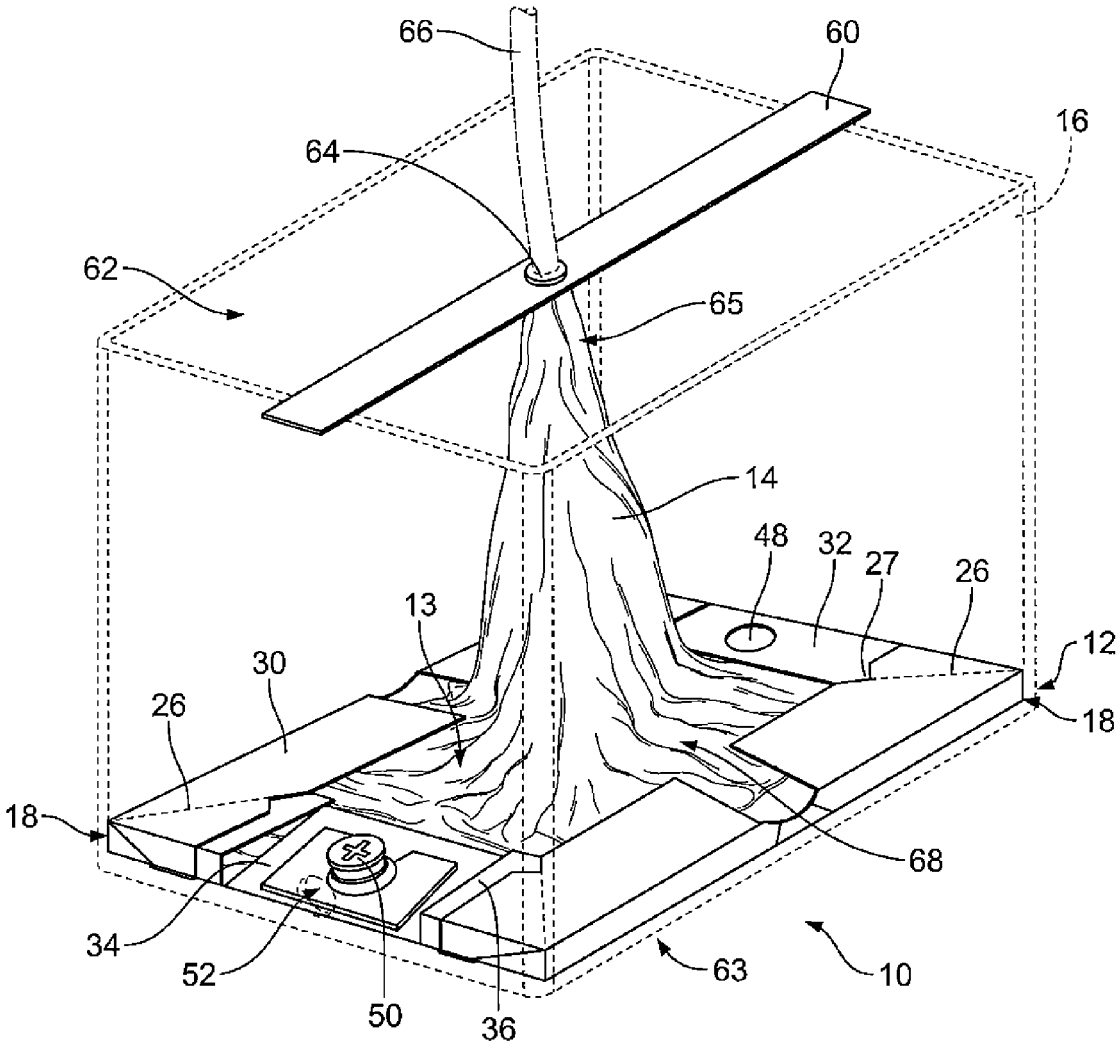
FIG. 7 is a perspective view of the cartridge of FIG. 2 inserted in a bulk container and in position to be filled with a flowable substance via a hose, the bulk container and hose shown in broken lines.

Referring now to FIGS. 1-9, and initially to FIGS. 2 and 7, there is shown a cartridge 10 for storing a flowable substance in a bulk container 16. The cartridge 10 is generally made up of a foldable shell 12 and a bag 14 positioned within the shell 12. The bag 14 is configured to be filled with the flowable substance. The cartridge 10 is configured to sit inside a bulk container 16, as shown in FIG. 7, to allow the bulk container 16 to be filled with the flowable substance. This flowable substance is often a liquid, but the cartridge 10 is suitable for holding other flowable substances as well.

The shell 12 of the present invention is preferably constructed by folding a blank of single-ply corrugated cardboard, however any other suitable material can be used. For purposes of this disclosure, the blank is considered to be the same article as the shell before folding, and both are indicated by the reference number "12". The blank for the preferred shell 12 is illustrated in FIG. 1, and includes a substantially rectangular base 20 with a plurality of flaps foldably attached thereto. For reference purposes, the shell 12 has a front end 28, a back end 29 opposite the front end 28, and two opposing sides 80 located between, and adjacent to, the front and back ends 28,29. The shell 12 additionally has a plurality of fold lines 70 and a center fold area 74 that allows the assembled shell 12 to fold at the center. This center fold area 74 preferably is created by two parallel center fold lines 72, and divides the base 20 into two substantially identical rectangular halves 21. Each of these center fold lines 72 allows the shell 12 to fold at a 90° angle, thereby allowing the entire shell 12 to fold 180° to a flat, compact shape, shown in FIGS. 4 and 5. Alternately, the center fold area 74 can contain only a single fold line which allows a 180° fold. In the preferred embodiment, each of the flaps attaches to the base 20 along a fold line 70, and most of the flaps have at least one additional fold line 70. These fold lines 70 are preferably created by scoring at the fold line 70 with a cutting tool, which eases folding. This cutting tool cuts widely spaced perforations in the cardboard to decrease resistance to folding. However, in other embodiments, the fold lines 70 are not scored, and other methods to ease folding are used. In still other embodiments, no method to ease folding is used at the fold lines 70.

The preferred shell 12 has two flaps 30 on each side 80, a single flap 32 at the back end 29, and three separate flaps 34,36 at the front end 28. Preferably, the front end 28 is specially adapted to engage the drain spout 50 of the bag 14, as described in further detail below. The back end flap 32 preferably has two fold lines 70 and an passage 48 defined in the back end flap 32, adapted to engage the drain spout 50 when the shell 12 is folded up, as described below. As illustrated in FIGS. 1 and 2, the first fold line 70 permits the back end flap 32 to fold upward at a 90° angle to the base 20. The second fold line 70, parallel to and spaced slightly from the first fold line 70, allows a portion 88 of the flap 32 to fold inward at a 90° angle. In alternate embodiments, other folding arrangements are used. The back end flap 32 preferably has angled edges 86 on the inward-folding portion 88. Two slots 42 are preferably present at the fold line 70 where the back end flap 32 connects to the base 20. Each slot 42 is preferably created by crushing a tab area 43 in the unfolded blank 12 at the fold line 70.

The blank 12 illustrated in FIG. 1 has three foldable flaps at the front end 28: two outer flaps 36 and an inner flap 34. The outer flaps 36 shown are mirror images of each other, each having an angled edge 84, two fold lines 70, and an inward folding portion 89 similar to those of the back end flap 32. Additionally, each outer flap 36 preferably has a slot 42 at the fold line 70 where the flap 36 connects to the base 20. The inner flap 34 preferably has an opening 44 defined within the flap 34 and configured to engage the drain spout 50 and to allow the drain spout 50 to extend through the flap 34. Preferably, the opening 44 has a larger portion 46 allowing the drain spout 50 to pass through easily, and a smaller portion 47 that fits tightly around the drain spout 50. In the preferred embodiment, the inner flap 34 is designed to fold differently than all the other flaps. The inner flap 34 has only a single fold line 70 and is configured to fold upward and inward at an acute angle to the base 20. In alternate embodiments, other folding arrangements are used.

The preferred shell 12 has four side flaps 30, two on each side 80, which are all similarly shaped. Each side flap 30 preferably has four fold lines 70, a tab 40, a breakable score line 26, and a cut-out portion adjacent the breakable score line 26. In the preferred embodiment, the first fold line 70 and the second fold line 70 on each side flap 30 are similar to the two fold lines 70 on the back end flap 32. The first fold line 70 permits the side flap 30 to fold upward at a 90° angle to the base 20. The second fold line 70, parallel to and spaced slightly from the first fold line 70, allows a portion 90 of the flap to fold inward at a 90° angle to form part of the top surface 24 of the shell 12. In the shell 12 illustrated in FIGS. 1-3, the side flaps 30 overlap the end flaps 32,36 when folded inward. Specifically, two of the side flaps 30 overlap a portion of the back end flap 32 and each of the remaining two side flaps 30 overlaps a portion of one of the outer front end flaps 36. The third fold line 70 is preferably configured to allow a portion 92 of the side flap 30 to fold downward over the respective end flap 32,36 at a 90° angle. Each side flap 30 preferably has a tab 40 at the very tip of the downward-folding portion 92. The fourth fold line 70 is positioned adjacent the tab 40 and allows the tab 40 to fold inward at a 90° angle to be received in the slot 42 near the end flap 32,36. When the tab 40 is received in the slot 42, the side flap 30 and the adjacent end flap 32,36 are secured in place. In alternate embodiments, other folding arrangements are used. Further, although the use of tabs 40 received in slots 42 is preferable, the shell 12 can be designed without either of these features. For example, the flaps can be secured via other means, such as adhesives, or may not be secured at all.

As described above, the present invention generally utilizes tabs 40 received in slots 42 to secure the folded flaps in place. The flaps having tabs 40 thereon generally overlap flaps without tabs 40, securing these flaps in place as well. As described above, the side flaps 30 preferably overlap the end flaps 32,36. However, in another embodiment, the end flaps overlap the side flaps and have tabs to secure the flaps in place. In still further embodiments, the tabs 40 are positioned and arranged differently, and the slots 42 are located elsewhere on the shell 12. Additionally, other folding arrangements for the flaps are incorporated in alternate embodiments.

Each side flap 30 also preferably has a breakable score line 26 arranged at an angle similar to the angle of the edges 84,86 of the back end flap 32 and the outer front end flaps 36. It is desirable for the breakable score lines 26 to be the weakest portion of the shell 12, to ensure that they tear before any other part of the shell 12 when pressure is applied. The breakable score lines 26 are preferably cut into the shell 12 using a cutting tool, but have much more narrowly-spaced scoring than do the fold lines 70, to further weaken the material. Each side flap 30 also preferably contains a cut-out portion 27 adjacent each of the breakable score line 26. These cut-out portions 27 are designed to focus stress at the tip of the breakable score line 26 and assist propagation of tears, to ensure that the weakest portion of the shell 12 is at the breakable score line 26. The breakable score lines 26 are preferably located on flaps that overlap other flaps, as described above. However, the score lines 26 can be located elsewhere on the shell 12 in accordance with the present invention, and may not be located on flaps at all.

A webbed portion 38 preferably connects the two side flaps 30 on each side 80 of the shell 12. The webbed portion 38 is folded upward from the base 20 at a 90° angle, and preferably contains multiple fold lines 39 to allow the webbed portion 38 to fold inward when the assembled shell 12 is folded at the center fold area 74.

Figure 3:
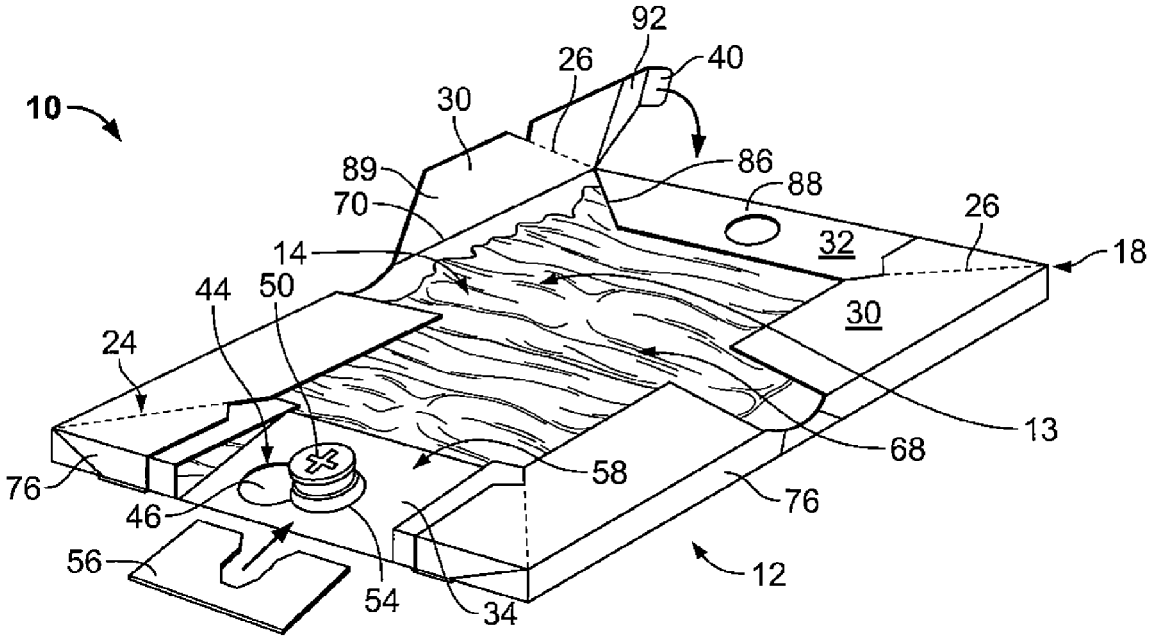
FIG. 3 is a perspective view of the cartridge of FIG. 2, illustrating how a side flap and a locking piece are attached to the cartridge.

The shell 12 illustrated in FIGS. 2 and 3 is formed by folding all the flaps of the above-described shell 12 inward. First the back end flap 32 and the two outer front end flaps 36 are folded upward and inward and the inner front end flap 34 is folded inward at an angle. Then the side flap 30 are all folded inward to overlap the end flaps 32,36. The end portions 92 of the side flap 30 are then folded downward and the tabs 40 are inserted in the slots 42, securing the side flap 30 and end flaps 36 in place. In this folded arrangement, the breakable score lines 26 extend to the corners 18 of the shell 12 and run immediately adjacent and parallel to the angled edges 84,86 of the end flaps 32,36 they overlap. Thus, the preferred assembled shell 12 is substantially rectangular in shape, having a substantially planar base 20, a substantially planar top surface 24, and four sidewalls 76 at the edges that create room for an inner cavity in the shell 12.

Preferably, the inward-folding flaps leave a sizeable open portion 68 in the top surface 24 of the shell 12 to allow access to the bag 14 contained within. Additionally, there is a passage 48 defined in the top surface 24 of the shell 12, to receive a portion of the drain spout 50 when the shell is folded at the center fold area 74. In the preferred embodiment, the passage 48 is defined within the back end flap 32, but the position and shape of the passage 48 can be adjusted as necessary. Further, the preferred shell 12 has a recessed portion 58 created by the angularly-folding inner front end flap 34. This recessed portion 58 creates a gap in both the top surface 24 and the sidewall of the shell 12. The shell 12 contains an opening 44 defined within the shell 12, preferably within the inner front end flap 34, and configured to engage the drain spout 50. This opening 44 is located approximately at the center of the recessed portion 58 in the preferred embodiment. In this embodiment, the recessed portion 58 extends at an angle from the base 20 to the top surface 24 of the shell 12, allowing the drain spout 50 to be at least partially sunken down below the top surface 24 of the shell 12. The sunken drain spout 50 facilitates folding of the cartridge 10 in half at the center fold area 74, in that it necessitates less clearance space. In other embodiments, the opening 44 is located elsewhere on the shell 12 and can take a different shape or configuration, such as a slot or groove. Alternately, the shell 12 can be designed without the opening 44.

Figure 4:
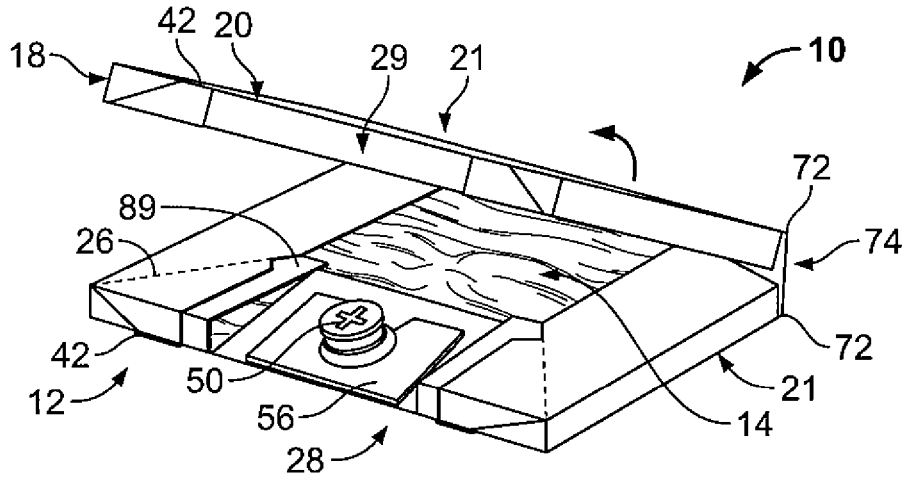
FIG. 4 is a perspective view of the cartridge of FIG. 2 in a partially-folded condition.

In the preferred embodiment, the assembled shell 12 can fold at the center fold area 74 to form a much more compact rectangular shape, as illustrated in FIGS. 4-5. As illustrated in FIGS. 2 and 3, the passage 48 is located at the opposite end of the unfolded shell 12 as the opening 44 engaging the drain spout 50. However, when the shell 12 is folded, a portion of the drain spout 50 is received in the passage 48, allowing for the folded shell 12 to have a thinner profile, and also assisting in holding the shell 12 in the folded position.

The preferred shell 12 contains at least one breakable score line 26 configured to separate due to force exerted on the shell 12 as the bag 14 is filled, allowing the bag 14 to expand inside the bulk container 16. As described above, the most preferred shell 12, shown in FIGS. 7-9, has four breakable score lines 26, one at each corner 18 of the shell 12 arranged at an angle to each corner 18. In this embodiment, each breakable score line 26 is located on one of the side flaps 30 and is positioned on the top surface 24 of the assembled shell 12 when the flaps are folded inward. In other embodiments, the shell 12 has a greater or fewer number of breakable score lines 26, and the score lines 26 are in other locations.

The cartridge 10 also contains a bag 14 located within the shell 12. The preferred bag 14 for use with the present invention is a flexible multi-ply polymer bag that is impermeable to fluids. Any other suitable type of bag can be used with the present invention, depending in part on what type of flowable substance is intended to be held by the bag. Preferably, a port 64 and a drain spout 50 are both in fluid communication with the bag 14. The port 64 is used for introducing the flowable substance into the bag 14 during filling, and the drain spout 50 is used for draining the flowable substance from the bag 14. The drain spout 50 preferably has a threaded valve (not shown in detail) that is opened by unscrewing the valve. The port 64 is preferably configured to interlock with a hose or tube 66 connected to a supply of the flowable substance, and has a valve (not shown) similar to that of the drain spout 50.

As shown in FIGS. 2-5 and 7-9, the bag 14 is preferably contained within an inner cavity 13 of the shell 12 created by the base 20 and the flaps. The open portion 68 in the top surface 24 of the shell 12 allows access to the bag 14, particularly the portion of the bag 14 containing the port 64, to facilitate filling of the bag 14. The drain spout 50 preferably extends through the opening 44 in the shell 12 to allow access to the spout 50. As described above, the opening 44 preferably contains a larger portion 46 and a smaller portion 47. In this arrangement, the drain spout 50 is inserted through the larger portion 46 and then slid over into the smaller portion 47, which engages the sides of the drain spout 50 to hold it in place.

To further secure the drain spout 50 in place, the preferred embodiment incorporates a separate locking piece 56 that slips around the portion of the drain spout 50 adjacent the opening to lock the drain spout 50 in the opening. The preferred configuration of the locking piece 56 is shown in FIG. 6, and is substantially C-shaped, having a long, straight edge 55 and a groove 57 dimensioned approximately the same as the diameter of the drain spout 50. The locking piece 56 is preferably made from solid fiber cardboard, but is made of other suitable materials in alternate embodiments. In the preferred embodiment, the drain spout 50 comprises a flange 54 and the separate locking piece 56 slips underneath the flange 54 and around the drain spout 50, as illustrated in FIG. 3. Further, the long edge 55 preferably abuts the fold line 70 of the inner front end flap 34 of the shell 12, resisting rotation of the drain spout 50. This resistance to rotation is most beneficial when unscrewing the valve to open the drain spout 50. In other embodiments, the locking piece 56 is configured differently, or is not used at all.

Figure 8:
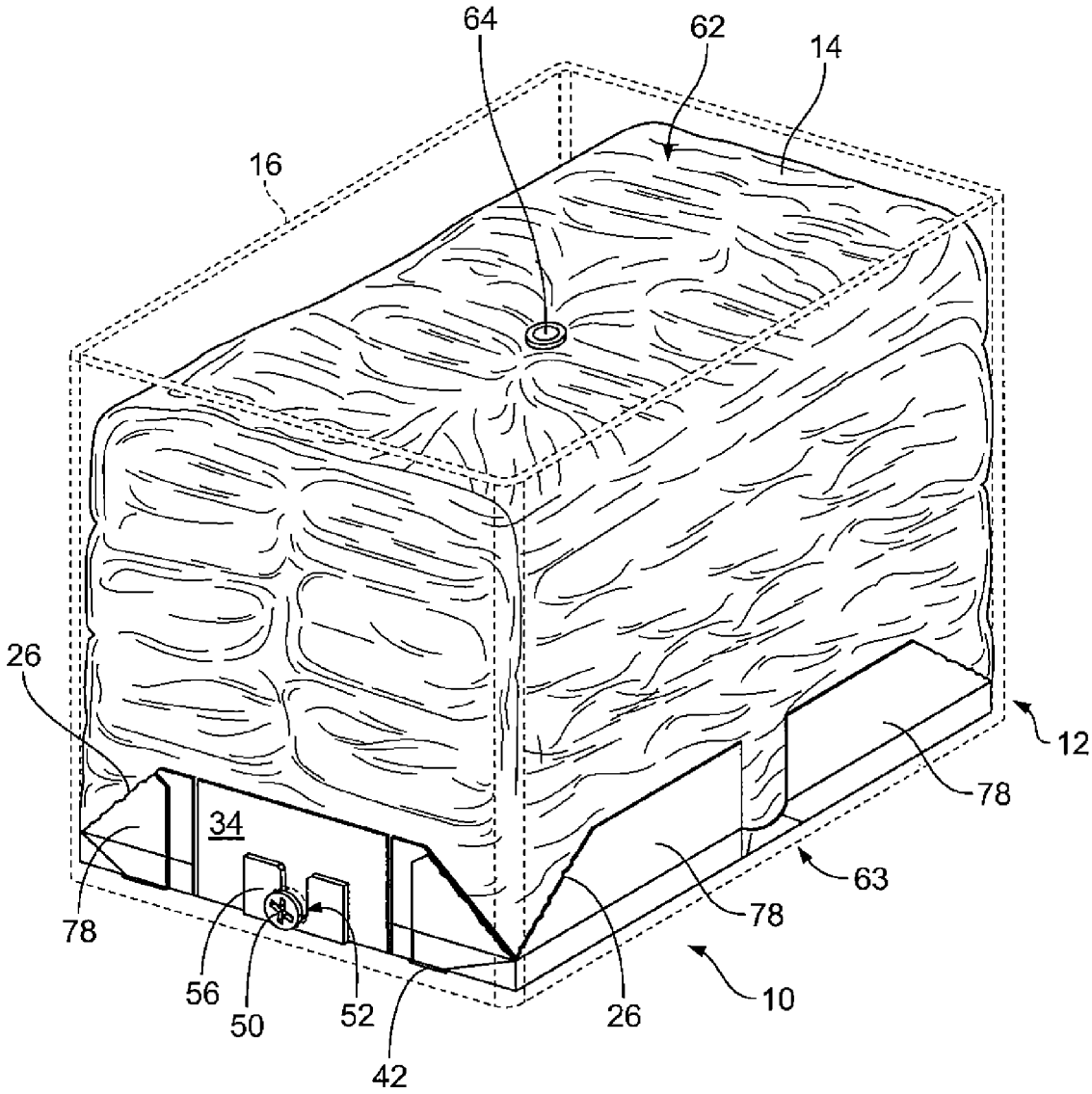
FIG. 8 is a perspective view of the cartridge and bulk container of FIG. 7 after filling with the flowable substance, the bulk container shown in broken lines; and, FIG. 9 is a side elevation view of the cartridge and bulk container of FIG. 7 in the process of being filled with the flowable substance.
Figure 9:
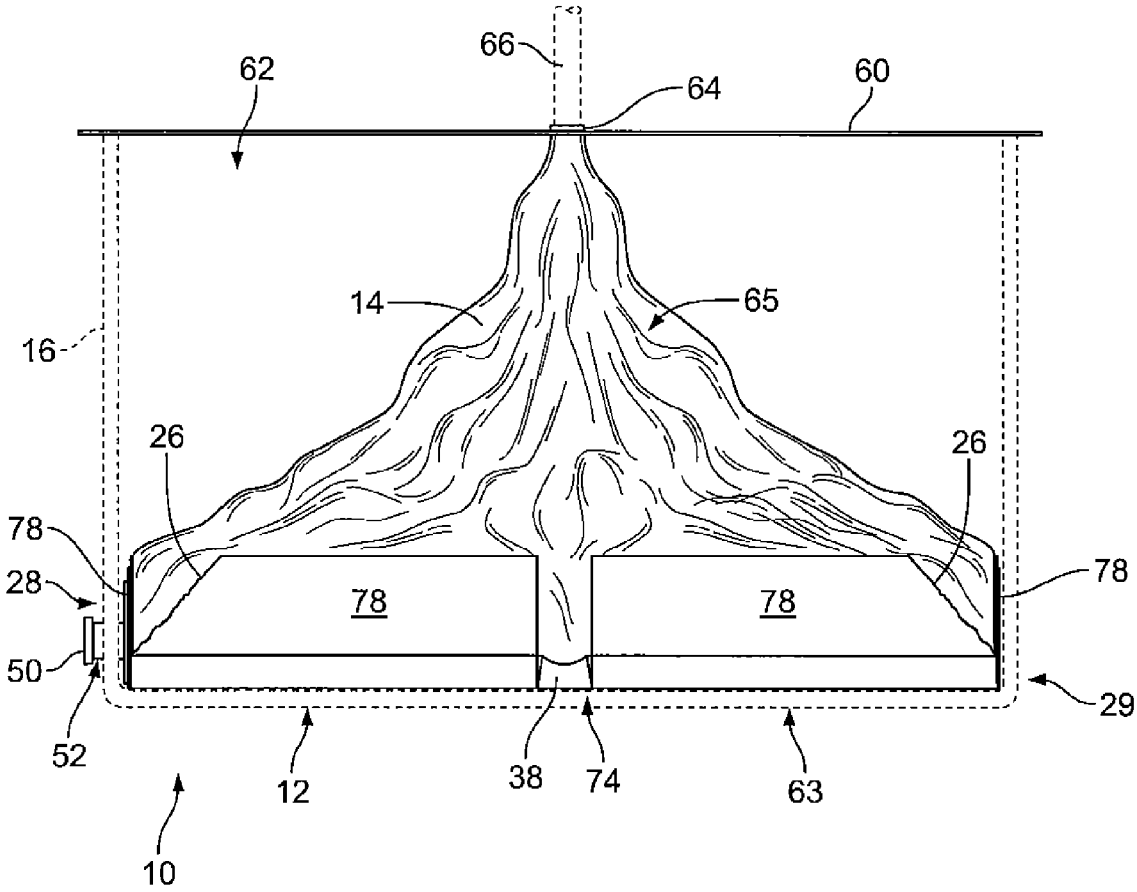

The disclosed cartridge 10 is useful in filling a bulk container 16 with a flowable substance. The preferred method of filling a bulk container 16 in accordance with the present invention is illustrated in FIGS. 7-9, and incorporates a bulk container 16 and a cartridge 10 including a shell 12 and a bag 14 contained within the shell 12. The shell 12 preferably has four breakable score lines 26 and the bag 14 has a port 64 for introducing the flowable substance into the bag 14, as described above. The cartridge 10 is placed within the bulk container 16 and unfolded in the bottom 63 of the container 16. Preferably, the cartridge 10 and the container 16 are cooperatively dimensioned so that the unfolded cartridge 10 is approximately the same size as the bottom 63 of the container 16. In other embodiments, the cartridge 10 and container 16 are configured differently, and the cartridge 10 can be designed to fit a variety of differently-shaped containers. Once the cartridge 10 is positioned in the bottom of the container 16, the bag 14 can be filled with the flowable substance.

Filling the bag 14 is preferably done by fixing a hose 66 in communication with a supply (not shown) of the flowable substance to the port 64 and filling the bag 14 through the port 64. Preferably, filling the bag 14 is facilitated by use of a bridge 60 extending across the top 62 of the container 16. As described above, the cartridge 10 preferably has an open portion 68 in the top surface 24 that permits access to the bag 14. A portion 65 of the bag 14 is pulled out of the cartridge 10 and attached to the bridge 60, as illustrated in FIG. 7, and the port 64 is located on this portion 65 of the bag 14. Preferably, the bridge 60 contains a slot (not shown), and the port 64 is attached to the bridge 60 by sliding the port 64 into the slot. Since the port 64 is then proximate the top 62 of the container 16, it is more easily accessed and affixed to the hose 66.

One the bag 14 begins to fill with the flowable substance, the pressure in the bag 14 increases. After some time, the force exerted on the shell 12 by this pressure becomes sufficiently great to cause the breakable score lines 26 to separate, allowing the bag 14 to expand inside the bulk container 16, as illustrated in FIG. 9. When the breakable score lines 26 separate, the top surface 24 of the shell 12 splits into four flaps 78 that fold outward against the sides of the bulk container 16. Additionally, the cartridge 10 and container 16 are preferably dimensioned and positioned so that the expanding bag 14 forces the drain spout 50 through a drain hole 52 in the bulk container 16, as illustrated in FIGS. 8-9. Eventually, the bag 14 is fill and the bulk container 16 can be transported. The flowable substance can be drained from the bulk container 16 using the drain spout 50, which projects through the drain hole 52 in the container 16.

The cartridge and method of the present invention provides an effective means for filling a bulk container with a flowable substance. The design of the cartridge allows the bag to be filled and drained with great ease. Additionally, the cartridge is quickly and easily assembled and is foldable into an extremely compact form that is easily stacked and palletized. Since all the flaps are secured in place until the breakable score lines separate, the cartridge can be transported and handled without fear that the cartridge will open at an inopportune time, allowing the bag to fall out. This shell configuration also ensures that the bag will be protected from damage before use. Further, the center folding arrangement allows the cartridge to be designed to fit a large variety of bulk container shapes. In particular, the disclosed cartridge is easily designed to fit rectangularly-shaped containers, with which some prior art devices have difficulty.

The terms "first," "second," "third," and "fourth," as used herein are intended for illustrative purposes only and do not limit the embodiments in any way. Further, the term "plurality" as used herein indicates any number greater than one, either disjunctively or conjunctively, as necessary, up to an infinite number.

While the specific embodiments have been illustrated and described, numerous modifications come to mind without significantly departing from the spirit of the invention, and the scope of protection is only limited by the scope of the accompanying Claims.

What is claimed is:

1. A method of filling a bulk container with a flowable substance comprising the steps of:

providing a cartridge comprising a shell and a bag within the shell configured to be filled with the flowable substance, the shell comprising a breakable score line, and the bag comprising a port for introducing the flowable substance into the bag;

placing the cartridge within the bulk container;

filling the bag by introducing the flowable substance into the bag through the port, wherein the breakable score line separates due to force exerted on the shell as the bag is filled, allowing the bag to expand inside the bulk container.

2. The method of claim 1, wherein the shell further comprises a plurality of breakable score lines, and the plurality of breakable score lines separate due to force exerted on the shell as the bag is filled, allowing the bag to expand inside the bulk container.

3. The method of claim 1, wherein the bag further comprises a drain spout, and the expanding bag forces the drain spout through a drain hole in the bulk container.

4. The method of claim 1, wherein the cartridge further comprises a fold line allowing the cartridge to fold into a more compact shape, and the method further comprises the step of unfolding the cartridge.

5. The method of claim 1, further comprising the steps of:

providing a bridge extending across an open top of the container;

attaching a portion of the bag proximate the port to the bridge; and fixing a hose to the port, the hose in communication with a supply of the flowable substance.

6. The method of claim 1, wherein the flowable substance is a liquid.

7. The method of claim 1, wherein the bag is constructed of an impermeable, multi-ply polymer.

* * * * *